United States Patent [19]

Jansa et al.

[11] 4,143,682

[45] Mar. 13, 1979

[54] MECHANISM FOR CONTROLLING THE PRESSURE FLUID SUPPLY TO THE WEFT INSERTING NOZZLES OF A MULTI-COLOR JET LOOM

[75] Inventors: Miloš Jansa; Juraj Spišiak; Stanislav Ferdus, all of Brno, Czechoslovakia

[73] Assignee: Vyzkumny a vyvojovy ustav Zavodu vseobecneho strojirenstvi, Brno, Czechoslovakia

[21] Appl. No.: 866,710

[22] Filed: Jan. 3, 1978

[30] Foreign Application Priority Data

Dec. 31, 1976 [CS] Czechoslovakia ..... 8877/76

[51] Int. Cl.[2] ..... D03D 47/30

[52] U.S. Cl. ..... 139/435

[58] Field of Search ..... 139/429, 435, 450

[56] References Cited

U.S. PATENT DOCUMENTS

| | | | |
|---|---|---|---|
| 3,828,829 | 8/1974 | Gotoh et al. | 139/435 |
| 3,905,402 | 9/1975 | Jansa et al. | 139/435 |
| 3,926,224 | 12/1975 | Vermeulen | 139/435 X |

*Primary Examiner*—Henry Jaudon

[57] ABSTRACT

There is disclosed a mechanism for controlling the pressure fluid supply to the weft inserting nozzles of jet looms provided with a device for color pick changes. The mechanism of the invention is used with a jet loom having a synchronizing pulse generator, the mechanism including a system of two parallel branches each of which comprises a series combination of pulse-shaping circuit, power amplifier, a solenoid-control valve, and a weft inserting nozzle, each of the branches having an input which is connected to a respective one of the outputs of the synchronizing pulse generator.

3 Claims, 3 Drawing Figures

MECHANISM FOR CONTROLLING THE PRESSURE FLUID SUPPLY TO THE WEFT INSERTING NOZZLES OF A MULTI-COLOR JET LOOM

This invention relates to a device for controlling the pressure fluid supply to the weft inserting nozzles of jet looms provided with a device for color pick changes.

When weaving two-color fabrics, it is necessary to feed the pressure fluid in a predetermined sequence into the respective weft inserting nozzles of the loom, the number of picks of the separate colored wefts being usually regularly alternated.

Known prior devices for controlling the pressure fluid supply into the weft inserting nozzles of two-color jet looms operate exclusively on mechanical principles. The valves for controlling the pressure fluid supply into the weft inserting nozzles are controlled by means of cams which are mounted on the shaft rotating at half the speed of the main shaft of the loom.

Such known devices have a number of disadvantages. Among such disadvantages is the necessity of a considerable amount of time for opening the valves, the high energy losses in the pressure fluid distribution caused by hydraulic resistance of the distribution circuit, the time of starting the opening and closing of the valves is usually not adjustable during operation of the loom and frequently requiring at least a partial disassembly of the loom. A further disadvantage of such prior devices is that the valves, due to the necessity of positioning them in proximity to the cam shaft, usually cannot be located at the optimum point of pressure fluid distribution.

The above-described disadvantages of prior devices are mitigated by the device in accordance with the present invention. Such device includes a system of two parallel branches, each of said branches comprising a series combination of pulse-shaping circuit, power amplifier, a solenoid-control valve, and a weft inserting nozzle, the input of each of such branches being connected to respective outputs of the synchronizing pulse generator of the loom.

Advantages of the device according to the present invention are the shortening of the time required for the opening and closing of the valves, diminishing the energy losses in the fluid distribution circuit, and the possibility of accurate adjustment of the moment of opening and closing the valves in a simple manner during the operation of the loom, the device of the invention operating in combination with the prearranged synchronizing pulse generator of the loom. A further advantage of the device according to the present invention is that it makes it possible to perform a complicated weft change.

Embodiments in the form of examples of the mechanism for controlling the pressure fluid supply to the weft inserting nozzles of multi-color jet looms in accordance with the present invention are shown in the accompanying drawings in which.

Figure 1:
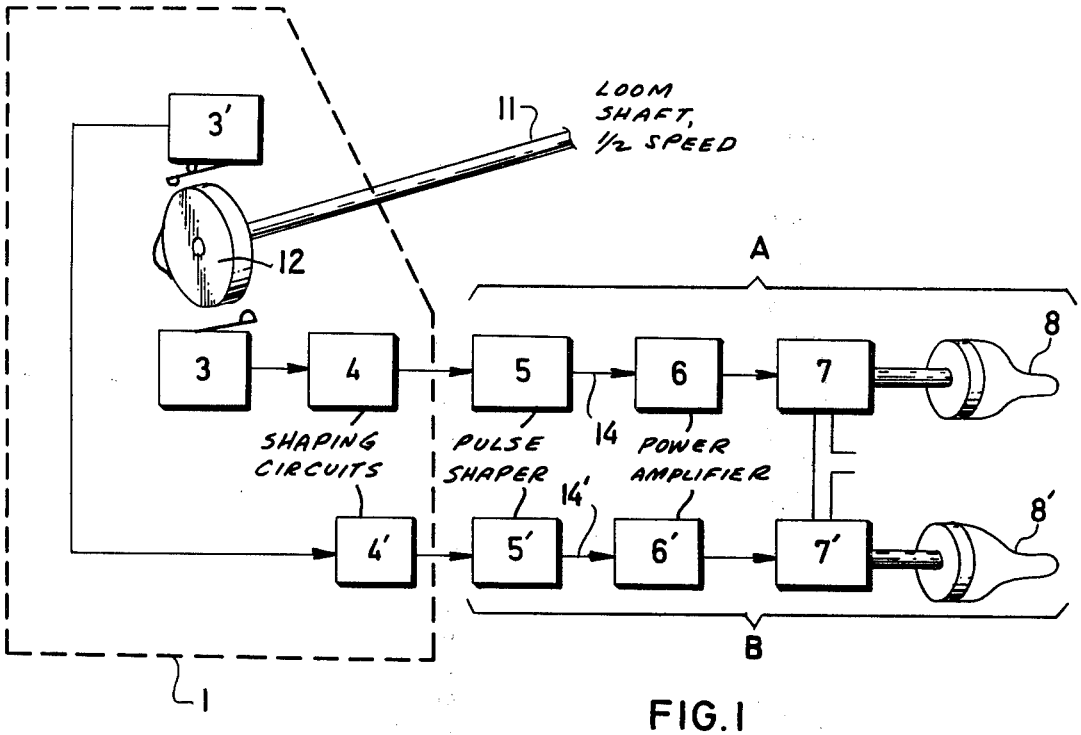
FIG. 1 is a schematic layout of a first embodiment of mechanism in accordance with the invention.

In the mechanism of FIG. 1 a synchronizing pulse generator 1 is operated by a shaft 11 which is driven at one-half the speed of the main shaft of the loom. Affixed to shaft 11 there is a means shown as a disc-like member 12, which coacts with position scanners 3 and 3' which are disposed 180° apart. Means 12 may be, for example, a single-lobed cam, as shown, and means 3, 3' may be switches, as shown, operated by the lobe of such cam. Alternatively, disc 12 may be an induction member and means 3 and 3' may be induction coils, as in the electronic distributors of modern automobiles. The synchronizing pulse generator includes two shaping circuits 4 and 4' the inputs of which are connected to the respective position scanners 3 and 3'. The outputs of shaping circuits 4 and 4' are connected to the respective branches A and B of the mechanism, branches A and B being identical. Branch A includes in the recited order the following means: a pulse shaper 5, a power amplifier 6, a solenoid-control valve 7, and a weft inserting nozzle 8. Branch B includes in the recited order the following series connected elements: a pulse shaper 5', a power amplifier 6', a solenoid control valve 7', and a weft inserting nozzle 8'.

Assuming that nozzle 8 of branch A is in operation, the synchronizing pulses from the output of synchronizing pulse generator 1 are shaped in the pulse shaper 5 and amplified by power amplifier 6. From the output of the power amplifier 6 such pulses are fed to the input of the solenoid controlled valve 7, which controls the pressure fluid supply to the weft inserting nozzle 8. The same sequence of events takes place in branch B when the weft inserting nozzle 8' is in operation.

Figure 2:
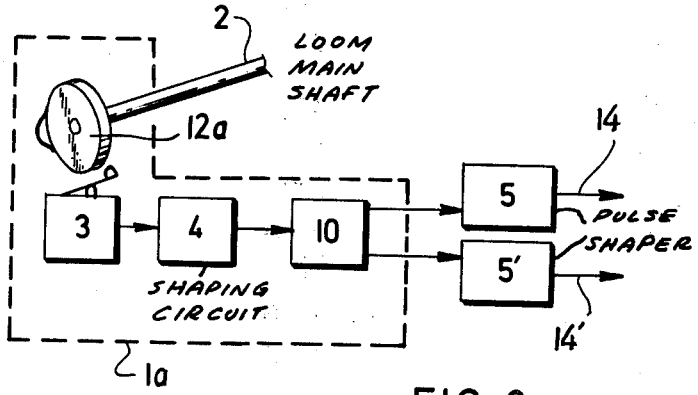
FIG. 2 is a fragmentary schematic layout of a second embodiment of the mechanism in accordance with the invention.

A second embodiment of the mechanism of the invention is shown in FIG. 2. In this embodiment the synchronizing pulse generator 1*a* includes a driven device, shown here as a disc 12*a* fixedly mounted upon the main shaft 2 of the loom. In this case a single position scanner in the form of a single lobe cam 12*a* and a switch 3 is employed, the output of scanner 3 being connected to the input of a shaping circuit 4. The output of shaping circuit 4 is connected to the input of a program evaluator 10. The program evaluator 10 has two outputs, such outputs being connected to respective ones of the pulse shapers 5, 5'. The remainder of the mechanism is identical with that shown in FIG. 1 and above-described. Thus lead 14 from pulse shaper 5 is connected to a power amplifier corresponding to amplifier 6 in branch A of FIG. 1, and lead 14' from pulse shaper 5' is connected to the input of a power amplifier 6' which is similar to the amplifier 6' in the branch B in the mechanism of FIG. 1.

In the operation of the mechanism of FIG. 2, a synchronizing pulse arrives at each revolution of main shaft 2 at the inputs of program evaluator 10. This pulse is switched over to the input of the appurtenant pulse shaper 5, 5' of the corresponding system branch, in dependence upon the color change program. The program evaluator 10 may comprise, for example, a sweep circuit of the T-type, i.e., a pulse bisector, whereupon only a simple alteration of the picking of the separate wefts is achieved. The program evaluator 10 may, however, also comprise more complicated electronic circuits, which may be programmable by known means or comprise a fixed program by means of which it is possible to provide for a large number of possibilities of changing the picking of the separate wefts, thereby allowing the use of simple patterning mechanism.

Figure 3:
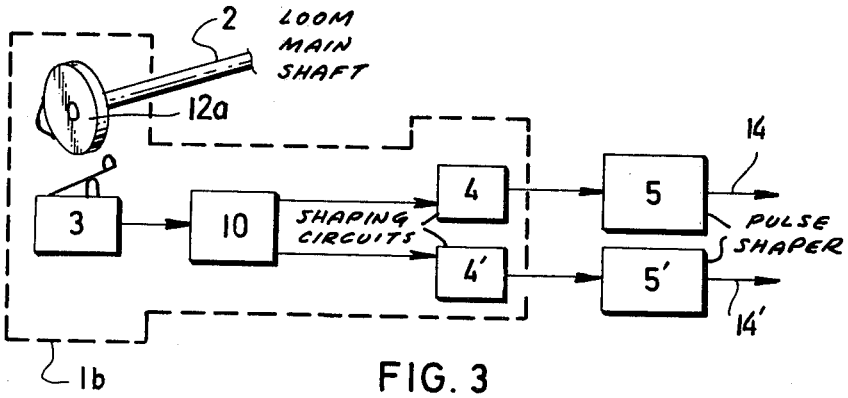
FIG. 3 is a view similar to FIG. 2 of a third embodiment of mechanism in accordance with the invention.

A third embodiment of mechanism in accordance with the invention is shown in FIG. 3. Parts which are similar to those in FIG. 2 are designated by the same reference characters. The synchronizing pulse generator 1*b* includes a single position scanner in the form of a single lobe cam 12*a* and a switch 3, a program evaluator 10, and shaping circuits 4, 4'. The program evaluator, however, is interposed between the position scanner and the shaping circuits, the outputs of the shaping circuits being connected to the inputs of the respective pulse shapers 5, 5'. As in the embodiment of FIG. 2, the leads 14, 14' from the outputs of the respective pulse shapers are connected to the respective power amplifiers in the two branches of the mechanism.

The embodiment of the mechanism shown in FIG. 3 is advantageous for weaving with wefts having different physical properties, because by means of individually adjustable shaping circuits 4, 4' it is possible to adjust the beginning and the end of the pulses at the output of the synchronizing pulse generator 1*b* for the separate branches of the system, and thus to adjust individually the optimum conditions for the picking of the separate wefts.

The mechanism according to the present invention can be advantageously extended to changing more than two wefts in a jet loom, either by modifying the program evaluator 10 and by extending the system by providing the necessary number of additional branches in the embodiment shown in FIGS. 2 and 3, or by modifying the synchronizing pulse generator 1 and extending the system for the necessary number of branches in the embodiment shown in FIG. 1.

Although in FIG. 3 the shaping circuits 4, 4' are shown disposed close to elements 12*a* and 3, they may be located remote from them, in an easily accessible part of the loom or on some other convenient support. This is particularly desirable when the shaping circuits are individually adjustable so that the beginning and the end of the pulses at the output of the synchronizing pulse generator can be readily adjusted, thus to achieve the optimum conditions for the picking of the separate wefts. It is also to be noted that within the scope of the invention the physical location of the shaping circuits 4, 4' in FIG. 1 relative to elements 3, 3', and 12, and the physical locations of elements 4 and 10 in FIG. 2 may be changed if found to be desirable.

Although the invention is illustrated and described with reference to a preferred plurality of embodiments thereof, it is to be expressly understood that it is in no way limited by the disclosure of such a plurality of embodiments, but is capable of numerous modifications within the scope of the appended claims. What is claimed is:

1. Mechanism for controlling the pressure fluid supply to a plurality of weft inserting nozzles of a jet loom provided with a mixing device for changing the wefts, comprising a synchronizing pulse circuit incorporating a single position scanner driven in synchronism with the loom, and circuit means having a plurality of identical parallel branches each having an input, each of said branches comprising a serially connected combination in the order named of a pulse shaper, a power amplifier, and a solenoid-controlled valve, a plurality of weft inserting nozzles, each solenoid-controlled valve being connected to and controlling a respective weft inserting nozzle, the synchronizing pulse generator having a plurality of outputs, and circuit means connecting each output of the synchronizing pulse generator to the input of a respective branch, a single shaping circuit, and a single program evaluator, the position scanner, shaping circuit, and program evaluator being connected in series, the program evaluator having a plurality of outputs, and comprising circuit means connecting the outputs of the program evaluator to the input of the respective pulse shaper.

2. Mechanism for controlling the pressure fluid supply to a plurality of weft inserting nozzles of a jet loom provided with a mixing device for changing the wefts, comprising a synchronizing pulse circuit incorporating a single position scanner driven in synchronism with the loom, and circuit means having a plurality of identical parallel branches each having an input, each of said branches comprising a serially connected combination in the order named of a pulse shaper, a power amplifier, and a solenoid-controlled valve, a plurality of weft inserting nozzles, each solenoid-controlled valve being connected to and controlling a respective weft inserting nozzle, the synchronizing pulse generator having a plurality of outputs, and circuit means connecting each output of the synchronizing pulse generator to the input of a respective branch, a single program evaluator having an input, and a plurality of shaping circuits each having an input, the position scanner having an output connected to the input of the program evaluator, the program evaluator having a plurality of outputs, the outputs of the program evaluator being connected to the inputs of the respective shaping circuits.

3. Mechanism for controlling the pressure fluid supply to a plurality of weft inserting nozzles of a jet loom provided with a mixing device for changing the wefts, comprising a synchronizing pulse circuit incorporating a single position scanner driven in synchronism with the loom, and circuit means having a plurality of identical parallel branches each having an input, each of said branches comprising a serially connected combination in the order named of a pulse shaper, a power amplifier, and a solenoid-controlled valve, a plurality of weft inserting nozzles, each solenoid-controlled valve being connected to and controlling a respective weft inserting nozzle, the synchronizing pulse generator having a plurality of outputs, and circuit means connecting each output of the synchronizing pulse generator to the input of a respective branch, a program evaluator having an input and a plurality of outputs, the output of the synchronizing pulse generator being connected to the input of the program evaluator and the outputs of the program evaluator being connected to the inputs of the respective pulse shapers.

* * * * *